United States Patent [19]

Inoue

[11] 4,431,345

[45] Feb. 14, 1984

[54] METHOD OF ASSEMBLING AND TESTING IN DOCK VERTICALLY MOVABLE MARINE WORKING PLATFORM STRUCTURE HAVING GROUNDABLE SUPPORT FRAMES

[75] Inventor: Takehisa Inoue, Tamano, Japan

[73] Assignee: Mitsui Engineering & Shipbuilding Co., Ltd., Tokyo, Japan

[21] Appl. No.: 221,287

[22] Filed: Dec. 30, 1980

[30] Foreign Application Priority Data

Feb. 22, 1980 [JP] Japan ..... 55-22112

[51] Int. Cl.[3] ..... E02D 23/02

[52] U.S. Cl. ..... 405/204; 405/195; 405/196

[58] Field of Search ..... 405/195–210, 405/229, 224

[56] References Cited

U.S. PATENT DOCUMENTS

| | | | |
|---|---|---|---|
| 868,092 | 10/1907 | Hennebique | 405/205 |
| 1,635,730 | 7/1927 | Tromanhauser | 405/195 |
| 2,939,290 | 6/1960 | Crake | 405/205 |
| 3,466,878 | 9/1969 | Esquillan et al. | 405/203 |
| 3,986,368 | 10/1976 | Levingston | 405/196 |
| 4,103,502 | 8/1978 | Cashman | 405/195 |
| 4,269,542 | 5/1981 | Mueller | 405/196 |
| 4,360,291 | 11/1982 | Cranberg et al. | 405/205 |

FOREIGN PATENT DOCUMENTS

| | | | |
|---|---|---|---|
| 616782 | 3/1961 | Canada | 405/195 |
| 425092 | 3/1911 | France | 405/195 |
| 1111660 | 11/1955 | France | 405/195 |

*Primary Examiner*—Dennis L. Taylor

*Attorney, Agent, or Firm*—Armstrong, Nikaido, Marmelstein & Kubovcik

[57] ABSTRACT

A method of assembling or testing a large-load, marine working platform structure, comprising the steps of laying sand on the bottom surface of a dock, and placing on the layer of sand spud cans attached to the lower ends of support frames of the working platform structure so as to scatter a load applied to the dock bed.

2 Claims, 6 Drawing Figures

METHOD OF ASSEMBLING AND TESTING IN DOCK VERTICALLY MOVABLE MARINE WORKING PLATFORM STRUCTURE HAVING GROUNDABLE SUPPORT FRAMES

BACKGROUND OF THE INVENTION

1. Field of the Invention

The present invention relates to a method of assembling and testing in a dry dock a large-scale, heavy-weight, marine working platform structure.

2. Description of the Prior Art

A vertically movable, marine working platform structure having groundable support frames is used as an apparatus or a base for carrying out a geological survey and oil-drilling in a comparatively shallow sea area.

The vertically movable, marine working platform structure, which is shown in side elevation in FIG. 1, consists of spud cans 3, support frames 2 set up on the spud cans 3, a working platform 1 supported on the frames 2, and lift means 4 provided in the working platform 1 so as to vertically move the same.

The working platform 1 is, for example, quadrangular and 65–70 m in length of one side thereof, or substantially triangular and 65–70 m in length of one side thereof. A total weight of the working platform structure including the weight of the support frames 2 is around not less than 7000 tons.

Each of the support frames 2, which are shown in plan in FIG. 2, consists of four steel pipes 2*a'* of 1 m in diameter which are set up such as to form a tower-like construction having a substantially square cross section the length of each side of which is on the order of 7 m. The area of each of the spud cans 3 attached to the lower end of each support frame 2 is 130 $m^2$, and at the time of testing, a load working on each of the spud cans 3 is as great as about 4000 tons. In order to have a dock bed bear the above-mentioned load, it is necessary that the dock bed has a pressure resistance of not less than 30 tons/$m^2$.

The spud cans 3 are adapted to be fixed in the sea bottom 5 in FIG. 1. They require to be immovably set in the sea bottom 5 in accordance with the condition of rocks, sand and mud therein. Therefore, each of the spud cans 3 has a somewhat inclined bottom surface 3*a* and a tip 3*b* in the central portion thereof as shown in FIG. 1. The tips 3*b* are made of forged steel. When the marine working platform structure is lowered to the sea bottom to allow the tips 3*b* to be placed on rocks, the rocks are broken by the tips 3*b*. As a result, the working platform structure is fixed in the sea bottom firmly.

When this working platform structure is placed as it is in a dock, a great concentrated load works on the dock bed due to the downwardly bulging bottom surfaces 3*a* of the spud cans 3 and the tips 3*b* provided in the central portions thereof, so that the dock bed cannot bear the load. Consequently, it is necessary in general that a plurality of supporting pieces be inserted in bottom portions of the spud cans 3 and that the number and position of the supporting pieces be adjusted to decentralize the stress. However, it is actually difficult to insert such supporting wooden pieces in the bottom portions of the spud cans 3, and it is impossible that a load be applied uniformly to the dock bed.

Each of the support frames 2, which are adapted to support the working platform 1 such that the working platform 1 can be vertically moved, consists of a plurality of several-tens meter long frame members which are joined to one another to a height of 100 m to form a tower-like construction.

Herein, a brief explanation will be entered in connection with conventional operations for the general assemblage of a working platform structure P:

1. Initially, it is operated in the site for the general assemblage to dispose and arrange a number of supporting wooden pieces or installation planks to a height of 1 to 2 m above the ground surface in a manner such that the upper end face of the number of planks correspond to the lower end face of a working platform 1 to be mounted thereon. At the same time, installation planks are similarly disposed below each spud can 3.

2. Then, component parts or segments of an appropriate dimensional specification into which the working platform 1 was preparatively divided are mounted on the installation planks and assembled altogether by for example welding to a complete assembly of the working platform 1. A same as above is operated of the spud cans 3, at the same time.

3. As soon as operations in the above paragraph 2 are substantially accomplished, there are steps initiated to mount an initial portion of support frames 2 and the lift means 4 respectively on spud cans 3 and the working platform 1. Then, the remaining support frames 2 are mounted one over the other.

4. Operations for outfit or equipment of the working platform 1 are worked opportunely during or parallel with the operations in the above paragraphs 2 and 3.

5. Upon completion of assembling and building of support frames 2 and of outfitting, tests are conducted to lift and lower the working platform 1 by the lift means 4 to thereby accomplish whole operations. Several-meter long frame members are then joined successively in the upward direction. Such a fragmentary operation is generally carried out in a dock or on a berth or a bench. The resulting working platform structure as a whole is extremely high and has large dimensions and a large total weight. An assembling machine, for example, a crane, to be used in a place for carrying out a comprehensive assembling operation for this type of working platform structure is limited in the height and outer sizes. Therefore, the working platform and lower portions of the support frames are combined first in a dry dock, and the resulting product is floated on the surface of the sea or fixed in the sea bottom so as to additionally join to the support frames a suitable number of support frame members successively in the upward direction by using a marine crane or a quay crane. Thus, an objective working platform structure is completed.

FIG. 4 illustrates a marine working platform structure P transferred to the surface of the sea, in which a support column member is being additionally joined to one of the support frames 2 by using a marine crane 10. In this type of assembling method, it is necessary that different steps of assembling a working platform structure P be carried out in different places. This causes an increase in the assembling cost and term of works.

It is difficult to find out near the place of manufacture of a vertically movable, marine working platform structure having groundable support frames such a sea area that is suitable to install the working platform structure P therein. When a working platform structure P is installed in a sea area with bad sea bottom condition, it is even in danger of falling.

A complete, vertically movable, marine working platform structure P having groundable support frames is subjected to various kinds of tests before it has been installed actually. The tests generally include the following.

(a) Jack-up and down test:

In this test, a working platform 1 is checked as to whether it is moved smoothly in the vertical direction along the support frames 2. Also, the performance of a jack, a kind of a lift means, is tested.

(b) Strength test:

Water is injected into the working platform 1 to set a load thereon to a maximum level, and the fastening strength of jack houses 11 in which jacks 4 are provided and the working platform 1, and the connecting strength of the jack house 11 and working platform 1 are then determined.

(c) Pressure resistance test:

A test to apply a load to the spud cans 3. Thus, the pressure resistance of the spud cans 3 is determined.

As referred to above, a vertically movable, marine working platform P having groundable support frames 2 is large in size and weight and requires to be subjected to various kinds of tests after it has been assembled. A conventional method of assembling and testing a marine working platform structure P cannot be practiced in a dock because the dock bed does not have a sufficiently high pressure resistance.

SUMMARY OF THE INVENTION

An object of the present invention is to eliminate the above-mentioned drawbacks encountered in a conventional method of assembling and testing a vertically movable, marine working platform structure having groundable support frames.

Another object of the present invention is to provide a method of assembling and testing in a dry dock a vertically movable, marine working platform structure having groundable support frames.

Still another object of the present invention is to provide a method of assembling and testing in a dry dock safely in a short period of time a vertically movable, marine working platform structure having groundable support frames.

In order to achieve the above objects, the present invention provides a method of assembling and testing in a dock a vertically movable, marine working platform structure having groundable support frames, characterized in that the method includes the steps of laying sand or a pressure resisting granular material on the bottom of a dry dock, and fixing in the sand or the granular material spud cans attached to the lower ends of the groundable support frames of the marine working platform structure, to thereby scatter a load applied to the base plates.

The above and other objects as well as the advantageous features of the invention will become apparent from the following description of the preferred embodiment taken in conjunction with the accompanying drawings.

DESCRIPTION OF THE PREFERRED EMBODIMENT

The present invention relates to a method of assembling in a dock a vertically movable, marine working platform structure having groundable support frames, and a method of testing the marine working platform structure after it has been assembled or in the midst of the assembling of the same.

To safely place such a heavy, marine working platform structure in a dock, uniformly scatter the weight of the marine working platform structure on the whole surfaces of spud cans attached to the lower ends of support frames thereof, and control the scattered load within the range of permissible stress in the dock bed have been problems in this technical field.

According to a method of the present invention of assembling a marine working platform structure in a dock, in which the above-mentioned problems have been skillfully solved, a layer of sand or a pressure resisting granular material is provided on a dock bed, and spud cans atached to the lower ends of support frames of the platform structure are fixed in the mentioned layer.

Figure 1:
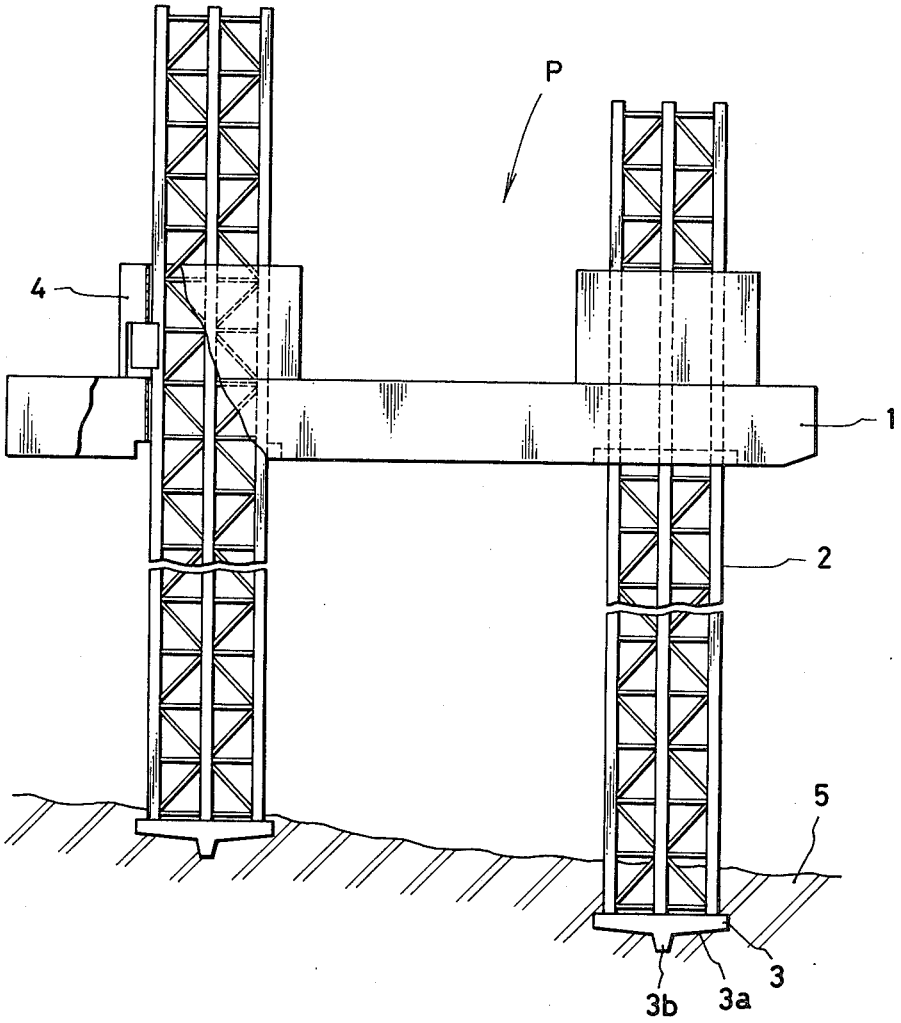
FIG. 1 is a side elevational view of a vertically movable, marine working platform structure having groundable support frames, which is fixed in the sea bottom.
Figure 2:
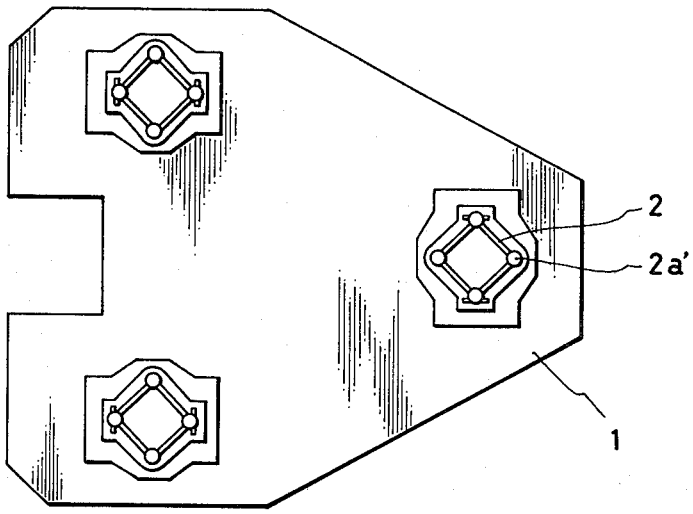
FIG. 2 is a plan view of the marine working platform structure shown in FIG. 1.
Figure 3:
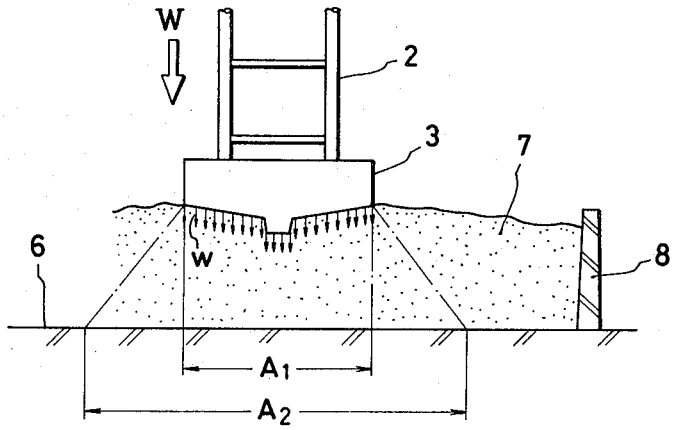
FIG. 3 is a side elevational view of a principal portion of a vertically movable, marine working platform structure having groundable support frames, which is fixed at its spud cans in sand or a pressure resisting granular material laid on the bottom of a dock, to thereby scatter a load applied to the spud cans.
Figure 4:
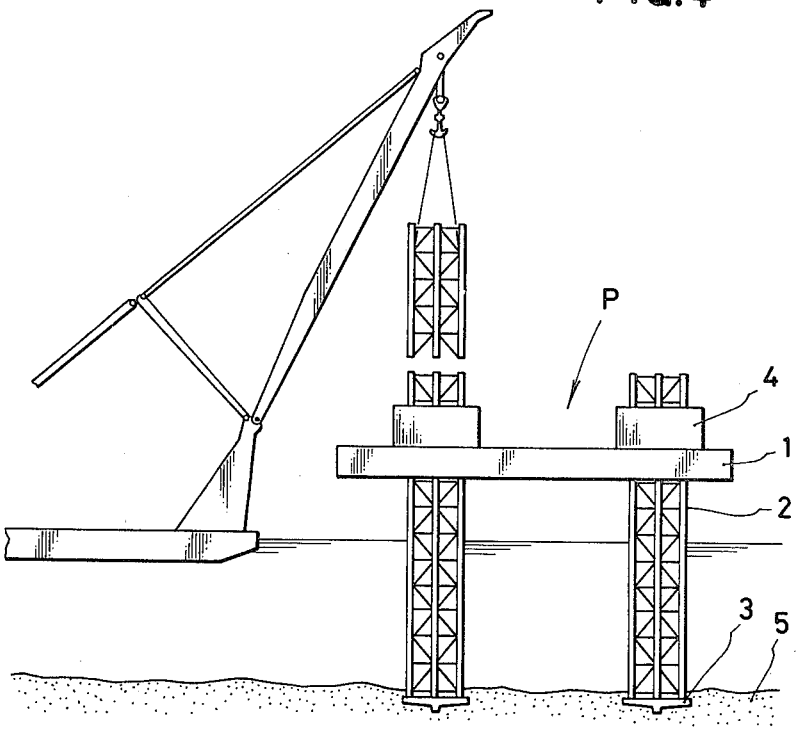
FIG. 4 is a side elevational view illustrating a conventional method of assembling a vertically movable, marine working platform structure having groundable support frames.

As shown in FIG. 3, an enclosure 8 is provided in a dock 6, and sand or a pressure resisting material 7 is placed in the enclosure 8. Spud cans 3 supporting the weight of the marine working platform structure are placed on the sand 7, and support frames 2 are set up on the spud cans 3 with a working platform 1 vertically movably provided on the support frames 2. The working platform 1 and support frames 2 are manufactured in a certain place away from the dock in most cases and assembled in the dock.

When a load W is applied to a spud cans 3 through a support frame 2 as shown in FIG. 3 distributed loads w occur, which are transmitted to a projected area $A_1$. If sand 7 of a selected or regulated quality is used, the distributed loads w can be uniformly applied to the projected area $A_2$ on the surface of the dock bed 6. Since the distributed loads are scattered to an area $A_2$, a load to be received by the surface of the dock bed 6 can be further reduced.

The sand 7 usually consists of one in a naturally dried state, and it may be forcibly dried or moistened as necessary to fluidize the same to a suitable extent, or to furnish the same with a frictional force.

Determining the thickness of a layer of sand is important to apply distributed loads uniformly to the dock bed. It is necessary that the thickness of a layer of sand be greater than a certain level. The thickness of a layer of sand may be determined such that a load is not locally applied to the surface of the dock bed 6 or such that, even when a load is locally applied to the surface of the dock bed 6, it is within the range of permissible stress in the dock bed 6. According to a number of experimental data, the thickness in reference may be within a range above 30 cm.

Figure 5:
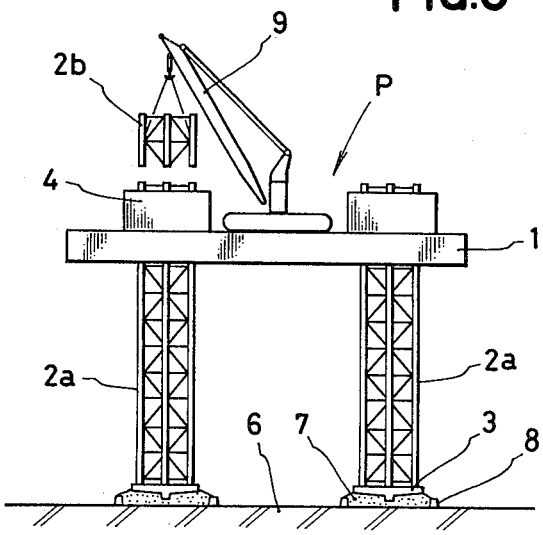
FIG. 5 is a side elevational view illustrating an early stage of a method of assembling a vertically movable, marine working platform structure having groundable support frames according to the present invention.
Figure 6:
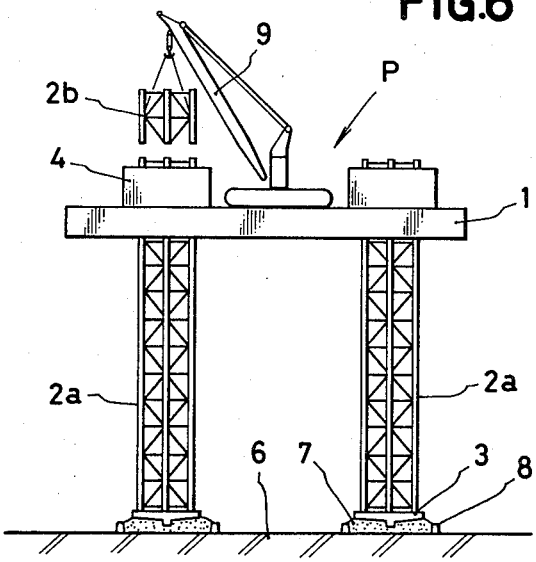
FIG. 6 is a side elevational view illustrating a little advanced stage of the method shown in FIG. 5.

FIGS. 5 and 6 are side elevational views illustrating different stages of a method of assembling a marine working platform structure according to the present invention. Lower portions of support frames 2 are joined to a working platform 1, and the resulting product is set up in a dock. A crane 9 is then installed on the working platform 1 to add a support frame member 2*b* successively to each of already-set-up support frame portions 2*a*. When one support frame member 2*b* has been added to each of the support frame portions 2*a*, the working platform 1 is moved upwardly to a position as shown in FIG. 6, by operating lift means 4, to further add a support frame member 2*b* to each of the resulting support frame portions 2*a*. The above operating is carried out repeatedly to add a required number of support frame members to each of the support frame portions 2*a*.

After a vertically movable, marine working platform structure having groundable support frames has been assembled in a dock in the above-mentioned manner, it is then subjected to various kinds of tests referred to above. In more detail, lift means 4 are actuated with a working platform 1 left unloaded and with the working platform 1 loaded to a maximum level by injecting water thereinto, to vertically move the working platform 1 along support frames 2 and observe the movement thereof in both cases. Also, strain occurring in the working platform 1 is measured with the working platform 1 left unloaded and with the working platform filled with water. A partial load is applied to the working platform or support frames to simulate a case where the marine working platform structure receives billows or a high-speed strong wind, and measure the movement of the working platform and strain in each part of the working platform structure.

At the same time that the above-mentioned tests are performed, the pressure resistance of spud cans is determined.

According to the present invention, which has been described above, a vertically movable, marine working platform structure P having groundable support frames, consisting of a working platform 1, support frames 2 on which the working platform 1 is supported, and spud cans 3 attached to the lower ends of the support frames 2 is set up on sand or a pressure resisting granular material laid on the bottom of a dock, and the resulting working platform structure is then subjected to various kinds of tests.

A method according to the present invention permits carrying out the above-described operations in a dry dock unlike a conventional method of this kind in which a part of a marine working platform structure is asembled on land with the remaining part assembled at sea. A method according to the present invention does not require such complicated operations. Moreover, it is not necessary to find a sea area the sea bed of which is suitable for assembling a marine working platform structure thereon. In other words, a vertically movable, marine working platform structure having groundable support frames can be assembled and then subjected to various kinds of tests in a dry dock around which no suitable sea area is available. Consequently, the term of works can be shortened, and the manufacturing cost can be reduced.

According to a method of the present invention, no concentrated load is applied to the bottom of a dock so that the dock bed is never damaged. Furthermore, machines and tools including cranes which are kept in a dock can be utilized. This allows the assembling and testing of a vertically movable, marine working platform structure having groundable support frames to be carried out easily. Unlike workers who assemble or test a marine working platform structure according to a conventional method of this kind, workers who carry out similar operations according to a method of the present invention do not require to take a boat to go to the scene of labor. Accordingly, a method of the present invention permits utilizing workers at a high efficiency.

The present invention is not, of course, limited to the above embodiment; it may be modified in various ways within the scope of the appended claims.

What is claimed is:

1. A method of assembling a vertically movable, marine working platform structure having groundable support frames, comprising the steps of:

placing a plurality of enclosure means in a dry dock, forming a support layer of pressure resistant granular material of a predetermined thickness in an area of the dock lying within each of the enclosure means, disposing spud cans on the layers of the pressure resistant granular material, mounting support frames on the spud cans, and securing a vertically movable working platform to the support frames.

2. A method of carrying out tests of a vertically movable, marine working platform structure having groundable support frames, which comprises the steps of:

placing a plurality of enclosure means in a dry dock, forming a support layer of pressure resistant granular material of a predetermined thickness in an area of the dock lying within each of the enclosure means, disposing spud cans on the layer of the pressure resistant granular material, securing a vertically movable working platform to the support frames, and performing a jack-up test and a strength measurement test of the working platform and a measurement of the pressure resistivity of the spud cans.

* * * * *